US012150474B2

(12) United States Patent
Luo et al.

(10) Patent No.: US 12,150,474 B2
(45) Date of Patent: Nov. 26, 2024

(54) COOLING CIGARETTE FILTER AND CIGARETTE

(71) Applicant: CHINA TOBACCO HUNAN INDUSTRIAL CO., LTD., Hunan (CN)

(72) Inventors: Wei Luo, Hunan (CN); Kejun Zhong, Hunan (CN); Wen Du, Hunan (CN); Lanying Xie, Hunan (CN); Liangsheng Qin, Hunan (CN); Jianhui Wen, Hunan (CN); Duo Ding, Hunan (CN); Guoyong Xie, Hunan (CN); Jianxin Ren, Hunan (CN); Zhiwei Sun, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 830 days.

(21) Appl. No.: 17/270,833

(22) PCT Filed: Oct. 24, 2018

(86) PCT No.: PCT/CN2018/111602
§ 371 (c)(1),
(2) Date: Feb. 23, 2021

(87) PCT Pub. No.: WO2020/037811
PCT Pub. Date: Feb. 27, 2020

(65) Prior Publication Data

US 2021/0315268 A1 Oct. 14, 2021

(30) Foreign Application Priority Data

Aug. 24, 2018 (CN) ..... 201810970483.6

(51) Int. Cl.

| | |
|---|---|
| ***A24D 3/04*** | (2006.01) |
| ***A24D 1/20*** | (2020.01) |
| | ***A24D 3/02*** |
| (2006.01) | ***A24D 3/06*** |
| (2006.01) | ***A24D 3/14*** |
| (2006.01) | |

(52) U.S. Cl.
CPC ..... *A24D 3/048* (2013.01); *A24D 1/20* (2020.01); *A24D 3/0275* (2013.01); *A24D 3/066* (2013.01); *A24D 3/067* (2013.01); *A24D 3/14* (2013.01)

(58) Field of Classification Search
CPC ..... A24D 3/08; A24D 1/20
See application file for complete search history.

(56) References Cited

U.S. PATENT DOCUMENTS 4,770,192 A 9/1988 De La Cerda
5,125,421 A 6/1992 Mitchell
(Continued)

FOREIGN PATENT DOCUMENTS

CN 1129089 A 8/1996
CN 101896082 A 11/2010
(Continued)

OTHER PUBLICATIONS

CN106490679A_Espacent Machine Translation (Year: 2017).*
(Continued)

*Primary Examiner* — Christopher M Rodd
*Assistant Examiner* — Ronnie Kirby Jordan
(74) *Attorney, Agent, or Firm* — MASCHOFF BRENNAN; Ran Pang; Michael Mauriel

(57) ABSTRACT

A cooling cigarette filter and a cigarette are disclosed. The cooling cigarette filter comprises a cooling section (2). The cooling section (2) comprises a cooling stick (201) formed from paper (5). The cooling stick (201) has one or more holes (202) communicating two ends of the cooling stick. And the surface of the paper (5) is coated with a cooling
(Continued)

material. The cooling cigarette filter has the advantages of ensuring the amount of smoke and lowering the temperature of the smoke entering the mouth. Through the combination design of the structure of the cooling stick and the type and amount of the cooling material, the smoke can flow out of a smoke generation section rapidly and smoothly And the temperature of the high-temperature smoke before entering the mouth can be significantly lowered, thereby improving the comfort and satisfaction of smoking.

20 Claims, 4 Drawing Sheets

(56) References Cited

U.S. PATENT DOCUMENTS

2012/0138073 A1* 6/2012 Cantrell et al. ..... A24B 15/00 131/111
2012/0323200 A1* 12/2012 Gagliardini ..... A61K 31/22 604/372
2021/0204595 A1* 7/2021 Chen et al. ..... A24D 3/04

FOREIGN PATENT DOCUMENTS

CN 102302218 A 1/2012
CN 106235403 A 12/2016
CN 106490679 A * 3/2017 ..... A24D 3/02
CN 106690415 A 5/2017
CN 107259639 A 10/2017
CN 107960680 A * 4/2018 ..... A24F 1/28
CN 108143004 A * 6/2018 ..... A24F 47/00

OTHER PUBLICATIONS

CN107960680A_ Espacenet Machine Translation (Year: 2018).*
CN108143004A_Espacenet Machine Translation (Year: 2018).*
International Search Report Issued in International Application No. PCT/CN2018/111602 dated May 30, 2019, 2 pages.

* cited by examiner

COOLING CIGARETTE FILTER AND CIGARETTE

CROSS REFERENCE TO RELATED APPLICATIONS

This application is a U.S. National Phase application under 35 U.S.C. § 371 of International Application No. PCT/CN2018/111602 filed on Oct. 24, 2018, which claims priority to Chinese Application No. 201810970483.6 filed on Aug. 24, 2018. The entire contents of these applications are hereby incorporated herein by reference.

FIELD OF THE INVENTION

The present invention relates to a cooling cigarette filter and a cigarette, and belongs to the field of cigarette manufacturing.

BACKGROUND OF THE INVENTION

A heat-not-burn cigarette heats tobacco substances through an external heating element, tobacco shreds or slices are only heated without burning, and an atomizing medium in the cigarette, flavor ingredients in the tobacco and additional flavor substances are heated to produce smoke, so the release of harmful chemical ingredients in the smoke is significantly reduced. At present, the mainstream heat-not-burn cigarettes on the market include iQOS from Philip Morris and glo from British American Tobacco. After the two kinds of cigarettes reach atomization temperatures under condition of heating at 250-350° C., the temperature of high-temperature atomized smoke entering the mouth through a filter section will be higher than the burning temperature of ordinary cigarettes, so that the smoke entering the mouth is too hot, and there are great differences from traditional cigarettes in terms of smoking experience, smoking feeling, etc.

The existing technologies mainly cool the high-temperature smoke flowing longitudinally through phase change cooling materials, for example, the materials for cooling sections of iQOS are mainly creased, pleated, aggregated and folded polylactic acid (PLA) sheets. The lengths of cigarette filters and the phase change cooling materials are limited, and the smoke flows relatively fast, so that it is difficult to cool the materials. The lateral heat transfer of the overheated smoke passing through the cigarette filter makes a consumer feel hot when smoking. In addition, the PLA sheets of the phase change cooling materials will melt after contacting the high-temperature smoke, so that smoke channels are blocked, which affects the cooling effect of the materials and even significantly reduces the amount of smoke.

Therefore, there is an urgent need for a cooling and low-filtering cigarette filter capable of effectively reducing the temperature of smoke of a heat-not-burn cigarette and improving the sensory quality of the smoke, and a heat-not-burn cigarette. The present invention solves such problems.

SUMMARY OF THE INVENTION

In view of the shortcomings of the existing technologies, the present invention provides a cooling cigarette filter and a cigarette to significantly reduce the temperature of high-temperature smoke entering the mouth and further improve and promote the smoking experience.

In order to solve the above technical problem, the technical solution of the present invention is as follows:

A cooling cigarette filter includes a cooling section, the cooling section includes a cooling stick formed from paper, the cooling stick has one or more holes communicating two ends of the cooling stick, and the holes are formed by paper which is repeatedly bended or folded in a cylindrical space; the surface of the paper is coated with a cooling material, and the coating amount of the cooling material is at least 15% of the total weight of the paper, generally 15% to 80%, further 20% to 70%, and preferably 30% to 60%.

By such a structural design, smoke to be cooled enters the cooling stick and then fully contacts the coated cooling material to exchange heat, and the heat of the smoke is transferred to the cooling material, so that the temperature of the smoke is lowered. In addition, the cooling stick has holes communicating its two ends, so the suction resistance is small, the smoke can pass easily, and the absorption of the smoke by the cooling stick is significantly reduced. The coating amount of the cooling material can be selected according to the cooling needs. Considering the cooling effect, the effect of smoke adsorption and the cost comprehensively, the applicant has found after repeated trials that the coating amount of the cooling material must reach a certain amount to achieve the cooling effect and entrap low smoke, and when the coating amount of the cooling material is less than 15%, good cooling effects cannot be achieved, and more smoke will be entrapped.

Compared with the existing cooling cigarette filters, first, the cooling stick of the present invention is mainly made of paper, and due to poor thermal conductivity of the paper, the heat absorbed by the cooling material is not easily transferred to the suction end fast, which can prevent burning the smoker; second, for a heat-not-burn cigarette, not matter whether it is central heating or surrounding heating, a large amount of water vapor will be generated during the first three puffs, and the high-temperature water vapor entering the mouth will condense and release a lot of heat, so that the hot feeling of the mouth (especially the tongue) is obviously enhanced, while the paper cooling stick of the present invention has good water vapor adsorption capacity, and can effectively adsorb water vapor, enhance the taste of the first three puffs and improve the smoking experience; third, after the cooling material is coated on the paper, the adsorption of particulate matters such as tar by the corresponding part of the paper can be reduced, so the cooling cigarette filter of the present invention adsorbs a very small amount of particulate matters in the smoke, which is beneficial to improving the smoking experience; in addition, the cooling cigarette filter of the present invention also has the cost advantage; taking the cost of the cooling stick as an example, during batch manufacturing, the manufacturing cost of each PLA honeycomb cooling stick is RMB 7 to 8 cents, the manufacturing cost of each PLA flaky cooling stick is RMB 2 to 3 cents, while the manufacturing cost of each cooling stick of the present application is only RMB 0.4 cents.

In some embodiments of the present invention, the cooling stick is formed by repeatedly bending the paper in a certain direction.

In some embodiments of the present invention, the cooling stick is formed by irregularly and repeatedly bending the paper, and the bending direction of the paper is irregular when viewed from the cross section.

Preferably, there are multiple holes.

Further, the cross section of the hole is irregular.

Further, one or both surfaces of the paper have multiple concave-convex lines, preferably folded lines. In this way, it can be ensured that the two ends of each hole are always communicated, and the smoke flows through each hole, which can reduce the suction resistance, fully exert the cooling effect of the cooling material, and reduce the adsorption of particulate matters in the smoke by the paper stick.

Further, the depth of the lines is 0.1 to 3 mm, and preferably, the interval between the adjacent lines is 0.5 to 15 mm.

Further, the paper is one of cellulose paper, coated paper and wrap paper, and preferably, the basis weight of the paper is 40 to 100 g/m$^2$. These types of paper have poor smoke adsorption capacity, can reduce smoke loss and improve the smoking experience, and are especially suitable for heat-not-burn cigarettes.

Further, the total specific surface area of the one or more holes is 10% to 50%, generally 15% to 40%, and preferably 20% to 35% of the surface area of the paper.

Further, the coating area of the cooling material on the surface of the paper is 50% to 100% of the surface area of the paper. The cooling material can be coated on one side or on both sides of the paper.

Further, one or both sides of the paper are coated with the cooling material.

In some embodiments of the present invention, the surface of the paper has a coating region coated with the cooling material and a blank region not coated with the cooling material, and the blank region and the coating region are distributed along the length of the cooling stick.

In some embodiments of the present invention, the cooling material is coated in at least two coating regions on a surface of the paper, and the coating regions are distributed along the length of the cooling stick. Accordingly, the coating regions can exert the cooling effect relatively independently to gradually cool the smoke, thereby improving the cooling effect. Further, different coating regions can be coated with different types of cooling materials.

Further, the cooling material is a phase change cooling material, which is preferably one or more of PEG (polyethylene glycol), polydextrose, and lactitol. The phase change cooling material has the ability of cooling. When the smoke passes through the cooling section, it fully contacts the cooling material, which can further improve the cooling effect.

Further, the PEG includes at least one of PEG-200, PEG-400, PEG-600, PEG-800, PEG-1000, PEG-1500, PEG-2000, PEG-4000, PEG-6000, PEG-8000, PEG-10000, and PEG-20000.

Further, the cooling material includes at least two of low molecular weight PEG, medium molecular weight PEG and high molecular weight PEG. The low molecular weight PEG includes one or more of PEG-200, PEG-400, PEG-600, and PEG-800; the medium molecular weight PEG includes PEG-1000, PEG-1500, PEG-2000, and PEG-4000; and the high molecular weight PEG includes one or more of PEG-6000, PEG-8000, PEG-10000, and PEG-20000. The applicant found after repeated trials that when the cooling material is formed by mixing two or three of low molecular weight PEG, medium molecular weight PEG and high molecular weight PEG, a good cooling effect often can be achieved, the amount of smoke entering the mouth is large, and the smoking experience is good; but when a certain molecular weight type of PEG is used alone, the desired cooling effect often cannot be achieved, the amount of smoke entering the mouth is small, and the smoking experience is poor. Preferably, in parts by mass, the cooling material includes 0-10 parts of low molecular weight PEG, 0-10 parts of medium molecular weight PEG and 0-10 parts of high molecular weight PEG, wherein the content of at most one of the low molecular weight PEG, the medium molecular weight PEG and the high molecular weight PEG is 0.

Further, the cooling stick is wrapped with wrap paper.

Further, the paper is rectangular when unfolded, which facilitates forming, and can also ensure that the cross-sectional areas of through holes in the length direction of the cooling stick are substantially the same after forming.

Further, a filter section is connected to one end of the cooling section, or two filter sections are respectively connected to two ends of the cooling section, and the filter section is preferably a cellulose acetate filter stick, and further preferably a special cellulose acetate filter stick which entraps low smoke.

Further, the filter section has a length of 5 to 9 mm, preferably 6 to 8 mm; and the cooling section has a length of 10 to 50 mm, preferably 16 to 35 mm.

Further, the cooling cigarette filter is a round stick, and further, has a perimeter of 17 to 24.2 mm.

The cooling cigarette filter of the present invention is especially suitable for heat-not-burn cigarettes. Generally, for central heating type heat-not-burn cigarettes and surrounding heat-not-burn cigarettes, the smoke temperature of the first three puffs is relatively high, reaching 60° C. or even more than 65° C. The cooling cigarette filter of the present invention can well meet the cooling needs, and can lower the temperature of smoke entering the mouth to about 46° C. to improve the smoking experience.

According to a preparation method of the above-mentioned cooling cigarette filter, the cooling material can be coated on the paper first, then the paper is fed into a forming machine to obtain a cooling stick, and the cooling stick is further processed to obtain the cooling cigarette filter.

Preferably, the tensile strength of the paper is more than 50 N/m to meet the stress requirements during the forming process.

Further, the paper coated with the cooling material is first cut into widths of 4 to 20 cm, the cut paper is pre-pressed with lines spaced by widths of 1 to 10 mm and having depths of 0.1 to 1.0 mm, then the pressed paper is fed into the forming machine to form the cooling stick, and the cooling stick is further processed to obtain the cooling cigarette filter. Further, the forming machine may be a ZL-23 forming machine.

A cigarette includes a smoke generation section and the above-mentioned cooling cigarette filter. Further, the cigarette is a heat-not-burn cigarette.

Further, the smoke generation section has a length of 10 to 70 mm, generally 10 to 50 mm, preferably 10 to 15 mm, and further preferably 11 to 13 mm.

Further, the smoke generation section is a tobacco strip composed of processed tobacco shreds or slices arranged in disorder.

The cooling section of the present invention has the characteristic of high temperature resistance (300-320° C.), the cooling section can be directly connected to the smoke generation section when the cigarette is designed, the melting and burning of the cooling section during smoking will not occur, and the cooling section still maintains its original shape, so the cigarette can be simplified to a three-section structure; the existing iQOS cigarette is designed to be in a four-section structure, its polylactic acid cooling section has poor high temperature resistance (melting point of 155-185° C.), is prone to completely melting when being directly connected to the smoke generation section, and cannot achieve the effect of cooling, so a high-temperature resistant diversion section should be disposed between the smoke generation section and the cooling section, wherein the temperature at the contact between the smoke generation section and the diversion section can reach about 220° C.

The cooling cigarette filter of the present invention has the advantages of ensuring the amount of smoke and lowering the temperature of the smoke entering the mouth, especially in the cooling section, through the combination design of the structure of the cooling stick and the type and amount of the cooling material, the smoke can flow out of the smoke generation section rapidly and smoothly, the temperature of the high-temperature smoke before entering the mouth can be significantly lowered, the amount of smoke is sufficient and the temperature is appropriate, thereby improving the comfort and satisfaction of smoking, and solving the problems of excessive water vapor, small amount of smoke and bad taste during the first three puffs of the existing heat-not-burn cigarettes; and the cooling cigarette filter has obvious cost advantage.

DETAILED DESCRIPTION OF THE EMBODIMENTS

The present invention will be described in detail below in conjunction with embodiments. It should be noted that the embodiments in the present invention and the features in the embodiments can be combined with each other without conflicts. For ease of narrative, the terms "upper", "lower", "left" and "right" described below are only consistent with the upper, lower, left and right directions of the drawings, and do not limit the structure.

Embodiment 1

Figure 1:
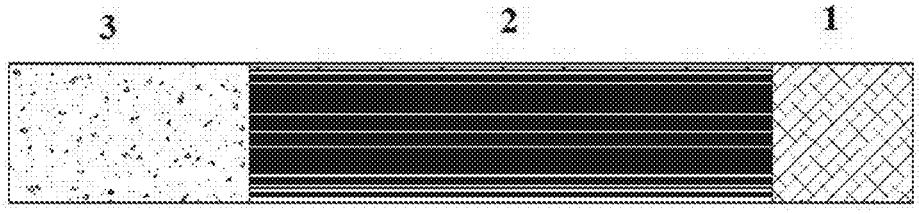
FIG. 1 is a schematic structural diagram of a cigarette according to the present invention.
Figure 2:
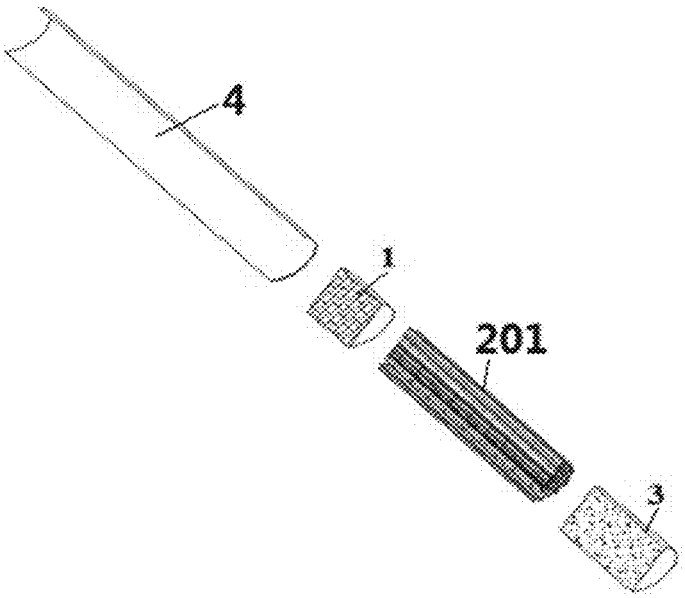
FIG. 2 is a three-dimensional sectional view (exploded view) of a cigarette according to the present invention.
Figure 3:
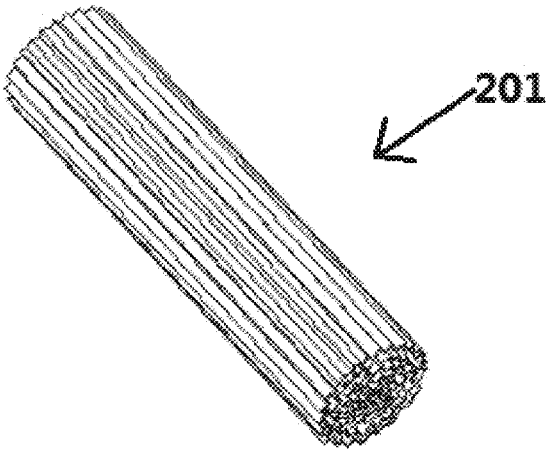
FIG. 3 is a schematic structural diagram of a cooling stick in FIG. 1.
Figure 4:
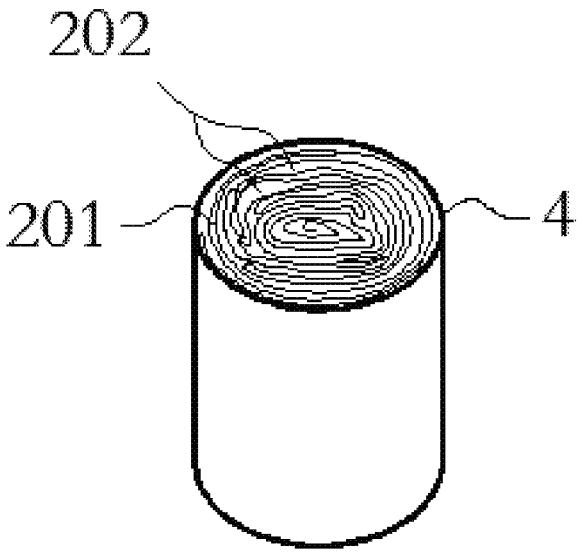
FIG. 4 is a physical diagram of a cooling stick according to the present invention (viewed along the length).
Figure 10:
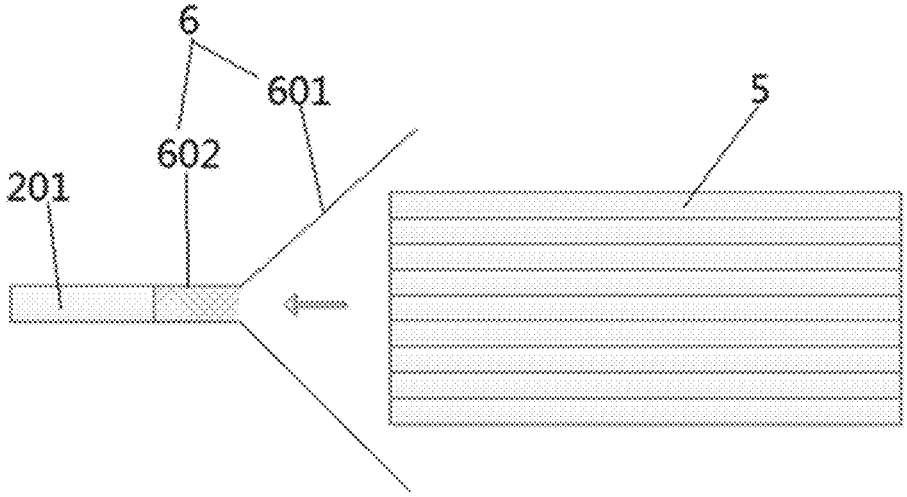
FIG. 10 is a schematic diagram of a forming process of a cooling stick according to the present invention.

As shown in FIG. 1, a heat-not-burn cigarette includes a filter section 1, a cooling section 2 and a smoke generation section 3 connected in sequence. The filter section is composed of a special cellulose acetate filter stick which has cooling function and entraps low smoke, the cooling section is formed by wrapping a cooling stick with wrap paper 4, and the cooling stick 201 is mainly formed by paper 5 coated with a phase change cooling material. The forming process of the cooling stick is shown in FIG. 10: the paper coated with the cooling material is first cut to be in a target size, the cut paper 5 is pre-pressed with lines, and then the pressed paper is fed into a ZL-23 forming machine to form the cooling stick. A mold 6 is used for the forming. The mold 6 includes a bell mouth 601 and a cavity 602 matching the cooling stick 201 in shape, the bell mouth 601 is butted with the cavity 602, and the paper enters the mold from a large open end of the bell mouth 601. The bell mouth can be provided with recessed and raised grooves therein, so that the paper is roughly in a wave shape when passing through the bell mouth, and the paper then can conveniently enter the cavity 602 for repeated bending and forming to obtain the cooling stick.

The cooling stick has a plurality of holes 202 communicating two ends of the cooling stick, and the total specific surface area of the plurality of holes is 20% to 30% of the surface area of the cooling paper.

The paper is cellulose paper with weak adsorption capacity. The basis weight of the paper is 60-80 g/m$^2$.

The cooling material is low molecular weight PEG200. The coating amount of the cooling material is 15% of the total weight of the paper.

After smoke enters the cooling section, it is in full contact with the phase change cooling material, which improves the cooling effect of the smoke, and also facilitates the rapid and smooth passing of the smoke generated in the cigarette.

The filter section has a length of 7 mm, the cooling section 2 has a length of 26 mm, and the smoke generation section has a length of 12 mm.

Through comparative studies, it is found that when the cooling section designed in the present invention is used to replace a creased PLA film cooling section in an iQOS cigarette for smoking tests, and a thermocouple is used to monitor the temperature, the maximum temperature of smoke entering the mouth is 67° C., which is 5° C. higher than the temperature of iQOS smoke entering the mouth; meanwhile, the total particulate matter in the smoke is reduced to 5.2 mg/cig, which is 10.0 mg/cig lower than that of the iQOS smoke; the amount of smoke entering the mouth is obviously decreased, the cooling cannot be achieved and more smoke will be entrapped, and the results are shown in Table 1.

Embodiment 2

Embodiment 1 is repeated, and only the cooling material is changed to low molecular weight PEG400. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 66° C., which is 4° C. higher than the temperature of iQOS smoke entering the mouth; meanwhile, the total particulate matter in the smoke is reduced to 5.0 mg/cig, which is 10.2 mg/cig lower than that of the iQOS smoke; the amount of smoke entering the mouth is obviously decreased, and the cooling effect cannot be achieved and more smoke will be entrapped (see Table 1).

Embodiment 3

Embodiment 1 is repeated, and only the cooling material is changed to low molecular weight PEG600. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 68° C., which is 6° C. higher than the temperature of iQOS smoke entering the mouth; meanwhile, the total particulate matter in the smoke is reduced to 4.8 mg/cig, which is 10.4 mg/cig lower than that of the iQOS smoke; the amount of smoke entering the mouth is obviously decreased, and the cooling effect cannot be achieved and more smoke will be entrapped (see Table 1).

Embodiment 4

Embodiment 1 is repeated, and only the cooling material is changed to low molecular weight PEG800. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 65° C., which is 3° C. higher than the temperature of iQOS smoke entering the mouth; meanwhile, the total particulate matter in the smoke is reduced to 4.7 mg/cig, which is 10.5 mg/cig lower than that of the iQOS smoke; the amount of smoke entering the mouth is obviously decreased, and the cooling effect cannot be achieved and more smoke will be entrapped (see Table 1).

Embodiment 5

Embodiment 1 is repeated, only the cooling material is changed to a mixture of low molecular weight PEG200 and PEG400, and the weight ratio of the two is 1:1. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 68° C., which is 6° C. higher than the temperature of iQOS smoke entering the mouth; meanwhile, the total particulate matter in the smoke is reduced to 4.6 mg/cig, which is 10.6 mg/cig lower than that of the iQOS smoke; the amount of smoke entering the mouth is obviously decreased, and the cooling effect cannot be achieved and more smoke will be entrapped (see Table 1).

Embodiment 6

Embodiment 1 is repeated, only the cooling material is changed to a mixture of low molecular weight PEG600 and PEG800, and the weight ratio of the two is 1:1. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 66° C., which is 4° C. higher than the temperature of iQOS smoke entering the mouth; meanwhile, the total particulate matter in the smoke is reduced to 4.2 mg/cig, which is 11.0 mg/cig lower than that of the iQOS smoke; the amount of smoke entering the mouth is obviously decreased, and the cooling effect cannot be achieved and more smoke will be entrapped (see Table 1).

Embodiment 7

Embodiment 1 is repeated, only the cooling material is changed to a mixture of low molecular weight PEG200, PEG600 and PEG800, and the weight ratio of the three is 1:1:1. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 65° C., which is 3° C. higher than the temperature of iQOS smoke entering the mouth; meanwhile, the total particulate matter in the smoke is reduced to 4.5 mg/cig, which is 10.7 mg/cig lower than that of the iQOS smoke; the amount of smoke entering the mouth is obviously decreased, and the cooling effect cannot be achieved and more smoke will be entrapped (see Table 1).

Embodiment 8

Embodiment 1 is repeated, only the cooling material is changed to a mixture of low molecular weight PEG200, PEG400 and PEG600, and the weight ratio of the three is 1:1:1. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 66° C., which is 4° C. higher than the temperature of iQOS smoke entering the mouth; meanwhile, the total particulate matter in the smoke is reduced to 4.7 mg/cig, which is 10.5 mg/cig lower than that of the iQOS smoke; the amount of smoke entering the mouth is obviously decreased, and the cooling effect cannot be achieved and more smoke will be entrapped (see Table 1).

Embodiment 9

Embodiment 1 is repeated, only the cooling material is changed to a mixture of low molecular weight PEG200, PEG400, PEG600 and PEG800, and the weight ratio of the four is 1:1:1:1. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 65° C., which is 3° C. higher than the temperature of iQOS smoke entering the mouth; meanwhile, the total particulate matter in the smoke is reduced to 5.0 mg/cig, which is 10.2 mg/cig lower than that of the iQOS smoke; the amount of smoke entering the mouth is obviously decreased, and the cooling effect cannot be achieved and more smoke will be entrapped (see Table 1).

Embodiment 10

Embodiment 1 is repeated, and only the cooling material is changed to medium molecular weight PEG1000. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 67° C., which is 5° C. higher than the temperature of iQOS smoke entering the mouth; meanwhile, the total particulate matter in the smoke is reduced to 5.2 mg/cig, which is 10.0 mg/cig lower than that of the iQOS smoke; the amount of smoke entering the mouth is obviously decreased, and the cooling effect cannot be achieved and more smoke will be entrapped (see Table 1).

Embodiment 11

Embodiment 1 is repeated, and only the cooling material is changed to medium molecular weight PEG1500. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 65° C., which is 3° C. higher than the temperature of iQOS smoke entering the mouth; meanwhile, the total particulate matter in the smoke is reduced to 4.6 mg/cig, which is 10.6 mg/cig lower than that of the iQOS smoke; the amount of smoke entering the mouth is obviously decreased, and the cooling effect cannot be achieved and more smoke will be entrapped (see Table 1).

Embodiment 12

Embodiment 1 is repeated, and only the cooling material is changed to medium molecular weight PEG2000. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 68° C., which is 6° C. higher than the temperature of iQOS smoke entering the mouth; meanwhile, the total particulate matter in the smoke is reduced to 4.5 mg/cig, which is 10.7 mg/cig lower than that of the iQOS smoke; the amount of smoke entering the mouth is obviously decreased, and the cooling effect cannot be achieved and more smoke will be entrapped (see Table 1).

Embodiment 13

Embodiment 1 is repeated, and only the cooling material is changed to medium molecular weight PEG4000. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 66° C., which is 4° C. higher than the temperature of iQOS smoke entering the mouth; meanwhile, the total particulate matter in the smoke is reduced to 4.3 mg/cig, which is 10.9 mg/cig lower than that of the iQOS smoke; the amount of smoke entering the mouth is obviously decreased, and the cooling effect cannot be achieved and more smoke will be entrapped (see Table 1).

Embodiment 14

Embodiment 1 is repeated, only the cooling material is changed to a mixture of medium molecular weight PEG1000 and PEG2000, and the weight ratio of the two is 1:1. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 68° C., which is 6° C. higher than the temperature of iQOS smoke entering the mouth; meanwhile, the total particulate matter in the smoke is reduced to 4.6 mg/cig, which is 10.6 mg/cig lower than that of the iQOS smoke; the amount of smoke entering the mouth is obviously decreased, and the cooling effect cannot be achieved and more smoke will be entrapped (see Table 1).

Embodiment 15

Embodiment 1 is repeated, only the cooling material is changed to a mixture of medium molecular weight PEG1500 and PEG4000, and the weight ratio of the two is 1:1. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 65° C., which is 3° C. higher than the temperature of iQOS smoke entering the mouth; meanwhile, the total particulate matter in the smoke is reduced to 4.9 mg/cig, which is 10.3 mg/cig lower than that of the iQOS smoke; the amount of smoke entering the mouth is obviously decreased, and the cooling effect cannot be achieved and more smoke will be entrapped (see Table 1).

Embodiment 16

Embodiment 1 is repeated, only the cooling material is changed to a mixture of medium molecular weight PEG1000, PEG1500 and PEG2000, and the weight ratio of the three is 1:1:1. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 66° C., which is 4° C. higher than the temperature of iQOS smoke entering the mouth; meanwhile, the total particulate matter in the smoke is reduced to 5.1 mg/cig, which is 10.1 mg/cig lower than that of the iQOS smoke; the amount of smoke entering the mouth is obviously decreased, and the cooling effect cannot be achieved and more smoke will be entrapped (see Table 1).

Embodiment 17

Embodiment 1 is repeated, only the cooling material is changed to a mixture of medium molecular weight PEG1500, PEG2000 and PEG4000, and the weight ratio of the three is 1:1:1. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 65° C., which is 3° C. higher than the temperature of iQOS smoke entering the mouth; meanwhile, the total particulate matter in the smoke is reduced to 5.4 mg/cig, which is 9.8 mg/cig lower than that of the iQOS smoke; the amount of smoke entering the mouth is obviously decreased, and the cooling effect cannot be achieved and more smoke will be entrapped (see Table 1).

Embodiment 18

Embodiment 1 is repeated, only the cooling material is changed to a mixture of medium molecular weight PEG1000, PEG1500, PEG2000 and PEG4000, and the weight ratio of the four is 1:1:1:1. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 67° C., which is 5° C. higher than the temperature of iQOS smoke entering the mouth; meanwhile, the total particulate matter in the smoke is reduced to 4.7 mg/cig, which is 10.5 mg/cig lower than that of the iQOS smoke; the amount of smoke entering the mouth is obviously decreased, and the cooling effect cannot be achieved and more smoke will be entrapped (see Table 1).

Embodiment 19

Embodiment 1 is repeated, and only the cooling material is changed to high molecular weight PEG6000. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 68° C., which is 6° C. higher than the temperature of iQOS smoke entering the mouth; meanwhile, the total particulate matter in the smoke is reduced to 5.5 mg/cig, which is 9.7 mg/cig lower than that of the iQOS smoke; the amount of smoke entering the mouth is obviously decreased, and the cooling effect cannot be achieved and more smoke will be entrapped (see Table 1).

Embodiment 20

Embodiment 1 is repeated, and only the cooling material is changed to high molecular weight PEG8000. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 67° C., which is 5° C. higher than the temperature of iQOS smoke entering the mouth; meanwhile, the total particulate matter in the smoke is reduced to 5.6 mg/cig, which is 9.6 mg/cig lower than that of the iQOS smoke; the amount of smoke entering the mouth is obviously decreased, and the cooling effect cannot be achieved and more smoke will be entrapped (see Table 1).

Embodiment 21

Embodiment 1 is repeated, and only the cooling material is changed to high molecular weight PEG10000. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 69° C., which is 7° C. higher than the temperature of iQOS smoke entering the mouth; meanwhile, the total particulate matter in the smoke is reduced to 5.4 mg/cig, which is 9.8 mg/cig lower than that of the iQOS smoke; the amount of smoke entering the mouth is obviously decreased, and the cooling effect cannot be achieved and more smoke will be entrapped (see Table 1).

Embodiment 22

Embodiment 1 is repeated, and only the cooling material is changed to high molecular weight PEG20000. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 68° C., which is 6° C. higher than the temperature of iQOS smoke entering the mouth; meanwhile, the total particulate matter in the smoke is reduced to 5.7 mg/cig, which is 9.5 mg/cig lower than that of the iQOS smoke; the amount of smoke entering the mouth is obviously decreased, and the cooling effect cannot be achieved and more smoke will be entrapped (see Table 1).

Embodiment 23

Embodiment 1 is repeated, only the cooling material is changed to a mixture of high molecular weight PEG6000 and PEG10000, and the weight ratio of the two is 1:1. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 67° C., which is 5° C. higher than the temperature of iQOS smoke entering the mouth; meanwhile, the total particulate matter in the smoke is reduced to 5.4 mg/cig, which is 9.8 mg/cig lower than that of the iQOS smoke; the amount of smoke entering the mouth is obviously decreased, and the cooling effect cannot be achieved and more smoke will be entrapped (see Table 1).

Embodiment 24

Embodiment 1 is repeated, only the cooling material is changed to a mixture of high molecular weight PEG8000 and PEG20000, and the weight ratio of the two is 1:1. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 68° C., which is 6° C. higher than the temperature of iQOS smoke entering the mouth; meanwhile, the total particulate matter in the smoke is reduced to 5.5 mg/cig, which is 9.7 mg/cig lower than that of the iQOS smoke; the amount of smoke entering the mouth is obviously decreased, and the cooling effect cannot be achieved and more smoke will be entrapped (see Table 1).

Embodiment 25

Embodiment 1 is repeated, only the cooling material is changed to a mixture of high molecular weight PEG6000, PEG8000 and PEG10000, and the weight ratio of the three is 2:3:9. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 67° C., which is 5° C. higher than the temperature of iQOS smoke entering the mouth; meanwhile, the total particulate matter in the smoke is reduced to 5.4 mg/cig, which is 9.8 mg/cig lower than that of the iQOS smoke; the amount of smoke entering the mouth is obviously decreased, and the cooling effect cannot be achieved and more smoke will be entrapped (see Table 1).

Embodiment 26

Embodiment 1 is repeated, only the cooling material is changed to a mixture of high molecular weight PEG8000, PEG10000 and PEG20000, and the weight ratio of the three is 9:3:1. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 69° C., which is 7° C. higher than the temperature of iQOS smoke entering the mouth; meanwhile, the total particulate matter in the smoke is reduced to 5.6 mg/cig, which is 9.6 mg/cig lower than that of the iQOS smoke; the amount of smoke entering the mouth is obviously decreased, and the cooling effect cannot be achieved and more smoke will be entrapped (see Table 1).

Embodiment 27

Embodiment 1 is repeated, only the cooling material is changed to a mixture of high molecular weight PEG6000, PEG8000, PEG10000 and PEG20000, and the weight ratio of the four is 7:5:8:2. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 67° C., which is 5° C. higher than the temperature of iQOS smoke entering the mouth; meanwhile, the total particulate matter in the smoke is reduced to 5.3 mg/cig, which is 9.9 mg/cig lower than that of the iQOS smoke; the amount of smoke entering the mouth is obviously decreased, and the cooling effect cannot be achieved and more smoke will be entrapped (see Table 1).

Embodiment 28

Embodiment 1 is repeated, only the cooling material is changed to a mixture of low molecular weight PEG400, medium molecular weight PEG4000 and high molecular weight PEG10000, and the weight ratio of the three is 1:1:1. The coating amount of the cooling material is 15% of the total weight of the paper. Through comparative studies, it is found that when the cooling section designed in the present invention is used to replace a creased PLA film cooling section in an iQOS cigarette, the maximum temperature of smoke entering the mouth is 61° C., which is 1° C. lower than the temperature of iQOS smoke entering the mouth; meanwhile, the total particulate matter in the smoke is 11.7 mg/cig, which is only 3.5 mg/cig lower than that of the iQOS smoke; and the cooling and low filtering effects are substantially achieved. The sensory quality of the smoke is improved to a certain extent (see Table 1).

Embodiment 29

Embodiment 1 is repeated, only the cooling material is changed to a mixture of low molecular weight PEG400, medium molecular weight PEG4000 and high molecular weight PEG10000, and the weight ratio of the three is 1:1:1. The coating amount of the cooling material is 25% of the total weight of the paper. Through comparative studies, it is found that when the cooling section designed in the present invention is used to replace a creased PLA film cooling section in an iQOS cigarette, the maximum temperature of smoke entering the mouth is 53° C., which is 9° C. lower than the temperature of iQOS smoke entering the mouth; meanwhile, the total particulate matter in the smoke is 14.9 mg/cig, which is only 0.3 mg/cig lower than that of the iQOS smoke; and the cooling and low filtering effects are achieved. The smoking sensory quality of the smoke is significantly improved (see Table 1).

Embodiment 30

Embodiment 1 is repeated, only the cooling material is changed to a mixture of low molecular weight PEG600, medium molecular weight PEG6000 and high molecular weight PEG20000, and the weight ratio of the three is 5:7:9. The coating amount of the cooling material is 35% of the total weight of the paper. Through comparative studies, it is found that when the cooling section designed in the present invention is used to replace a creased PLA film cooling section in an iQOS cigarette, the maximum temperature of smoke entering the mouth is 51° C., which is 11° C. lower than the temperature of iQOS smoke entering the mouth; meanwhile, the total particulate matter in the smoke is 15.5 mg/cig, which is 0.3 mg/cig higher than that of the iQOS smoke; and the cooling and low filtering effects are achieved. The smoking sensory quality of the smoke is significantly improved (see Table 1).

Embodiment 31

Embodiment 1 is repeated, only the cooling material is changed to a mixture of low molecular weight PEG600 and medium molecular weight PEG4000, and the weight ratio of the two is 1:1. The coating amount of the cooling material is 30% of the total weight of the paper. Through comparative studies, it is found that when the cooling section designed in the present invention is used to replace a creased PLA film cooling section in an iQOS cigarette, the maximum temperature of smoke entering the mouth is 52° C., which is 10° C. lower than the temperature of iQOS smoke entering the mouth; meanwhile, the total particulate matter in the smoke is 15.7 mg/cig, which is 0.5 mg/cig higher than that of the iQOS smoke; and the cooling and low filtering effects are achieved. The smoking sensory quality of the smoke is significantly improved (see Table 1).

Embodiment 32

Embodiment 1 is repeated, only the cooling material is changed to a mixture of low molecular weight PEG400 and high molecular weight PEG20000, and the weight ratio of the two is 5:2. The coating amount of the cooling material is 50% of the total weight of the paper. Through comparative studies, it is found that when the cooling section designed in the present invention is used to replace a creased PLA film cooling section in an iQOS cigarette, the maximum temperature of smoke entering the mouth is 45° C., which is 13° C. lower than the temperature of iQOS smoke entering the mouth; meanwhile, the total particulate matter in the smoke is 15.2 mg/cig, which is the same as that of the iQOS smoke; and the cooling and low filtering effects are achieved. The smoking sensory quality of the smoke is significantly improved (see Table 1).

Embodiment 33

Embodiment 1 is repeated, only the cooling material is changed to a mixture of low molecular weight PEG400, medium molecular weight PEG4000 and high molecular weight PEG8000, and the weight ratio of the three is 9:2:9. The coating amount of the cooling material is 80% of the total weight of the paper. Through comparative studies, it is found that when the cooling section designed in the present invention is used to replace a creased PLA film cooling section in an iQOS cigarette, the maximum temperature of smoke entering the mouth is 48° C., which is 14° C. lower than the temperature of iQOS smoke entering the mouth; meanwhile, the total particulate matter in the smoke is 15.5 mg/cig, which is 0.3 mg/cig higher than that of the iQOS smoke; and the cooling and low filtering effects are achieved. The smoking sensory quality of the smoke is significantly improved (see Table 1).

Embodiment 34

Figure 5:
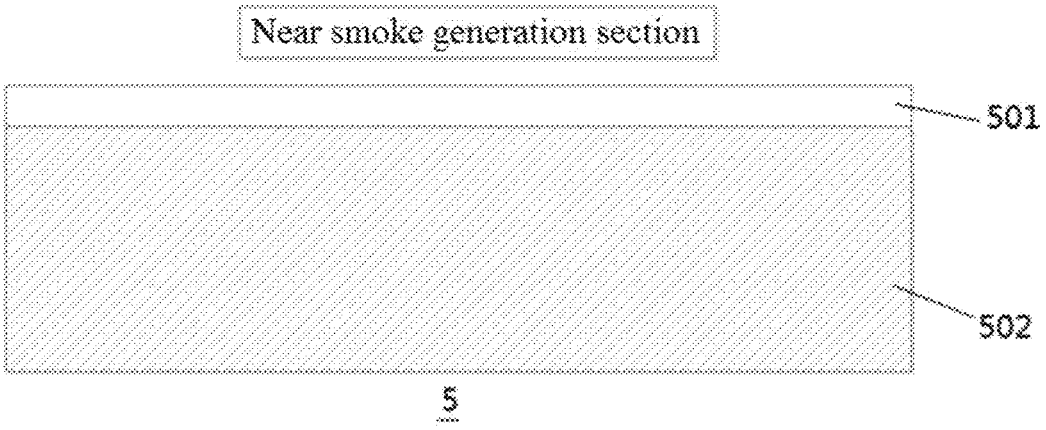
FIG. 5 is a schematic diagram of a coating manner of a cooling material on paper in Embodiment 34.

Embodiment 1 is repeated, the coating manner of the cooling material on the paper is changed, as shown in FIG. 5, a part of the paper 5 which is 0 to 4 mm from the smoke generation section (blank region 501) is not coated with the cooling material, the remaining part (coating region 502) is coated with a mixture of low molecular weight PEG600, medium molecular weight PEG4000, high molecular weight PEG8000 and lactitol, and the weight ratio of the four is 6:2:3:1. The coating amount of the cooling material is 40% of the total weight of the paper. Through comparative studies, it is found that when the cooling section designed in the present invention is used to replace a creased PLA film cooling section in an iQOS cigarette, the maximum temperature of smoke entering the mouth is 51° C., which is 11° C. lower than the temperature of iQOS smoke entering the mouth; meanwhile, the total particulate matter in the smoke is 15.0 mg/cig, which is only 0.2 mg/cig lower than that of the iQOS smoke; and the cooling and low filtering effects are achieved. The smoking sensory quality of the smoke is significantly improved (see Table 1).

Embodiment 35

Figure 6:
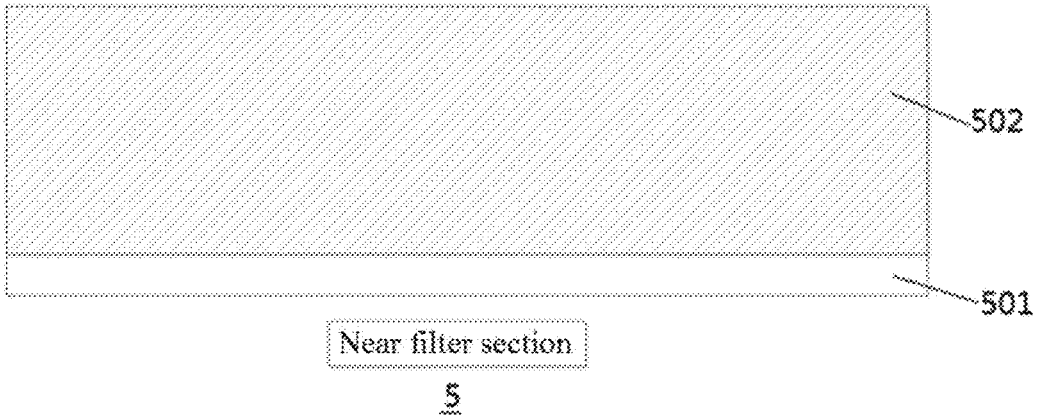
FIG. 6 is a schematic diagram of a coating manner of a cooling material on paper in Embodiment 35.

Embodiment 1 is repeated, the coating manner of the cooling material on the paper is changed, as shown in FIG. 6, a part of the paper which is 0 to 4 mm from the suction end (blank region 501) is not coated with the cooling material, the remaining part (coating region 502) is coated with a mixture of low molecular weight PEG800, medium molecular weight PEG6000 and polydextrose, and the weight ratio of the three is 2:1:1. The coating amount of the cooling material is 45% of the total weight of the paper. Through comparative studies, it is found that when the cooling section designed in the present invention is used to replace a creased PLA film cooling section in an iQOS cigarette, the maximum temperature of smoke entering the mouth is 52° C., which is 11° C. lower than the temperature of iQOS smoke entering the mouth; meanwhile, the total particulate matter in the smoke is 15.1 mg/cig, which is only 0.1 mg/cig lower than that of the iQOS smoke; and the cooling and low filtering effects are achieved. The smoking sensory quality of the smoke is significantly improved (see Table 1).

Embodiment 36

Figure 7:
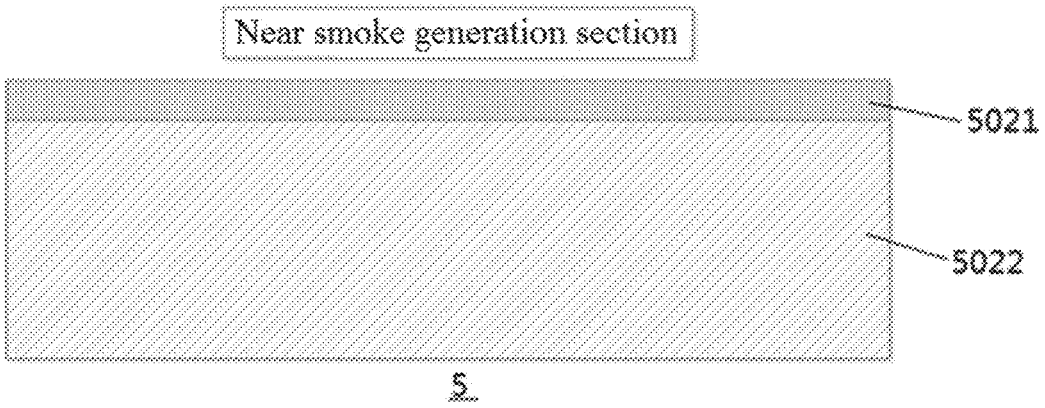
FIG. 7 is a schematic diagram of a coating manner of a cooling material on paper in Embodiment 36.

Embodiment 1 is repeated, the coating manner of the cooling material on the paper is changed, as shown in FIG. 7, a part of the paper which is 0 to 4 mm from the smoke generation section (first coating region 5021) is coated with a polydextrose cooling material, the remaining part (second coating region 5022) is coated with low molecular weight PEG800, medium molecular weight PEG4000 and high molecular weight PEG20000, and the weight ratio of the three is 2:2:1. The coating amount of the cooling material is 35% of the total weight of the paper. Through comparative studies, it is found that when the cooling section designed in the present invention is used to replace a creased PLA film cooling section in an iQOS cigarette, the maximum temperature of smoke entering the mouth is 47° C., which is 15° C. lower than the temperature of iQOS smoke entering the mouth; meanwhile, the total particulate matter in the smoke is 15.4 mg/cig, which is 0.2 mg/cig higher than that of the iQOS smoke; and the cooling and low filtering effects are achieved. The smoking sensory quality of the smoke is significantly improved (see Table 1).

Embodiment 37

Figure 8:
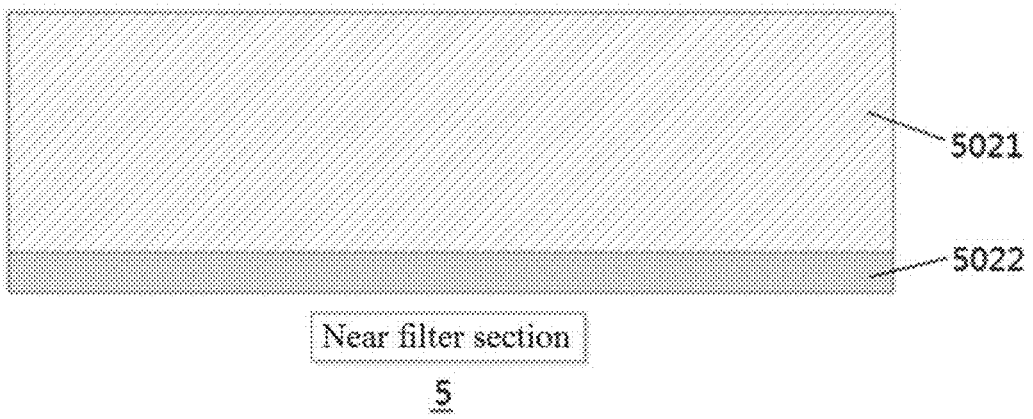
FIG. 8 is a schematic diagram of a coating manner of a cooling material on paper in Embodiment 37.

Embodiment 1 is repeated, the coating manner of the cooling material on the paper is changed, as shown in FIG. 8, a part of the paper which is 0 to 4 mm from the suction end (second coating region 5022) is coated with a lactitol cooling material, the remaining part (first coating region 5021) is coated with a mixture of low molecular weight PEG400, medium molecular weight PEG1500 and high molecular weight PEG10000, and the weight ratio of the three is 1:2:2. The coating amount of the cooling material is 30% of the total weight of the paper. Through comparative studies, it is found that when the cooling section designed in the present invention is used to replace a creased PLA film cooling section in an iQOS cigarette, the maximum temperature of smoke entering the mouth is 48° C., which is 14° C. lower than the temperature of iQOS smoke entering the mouth; meanwhile, the total particulate matter in the smoke is 15.6 mg/cig, which is 0.4 mg/cig higher than that of the iQOS smoke; and the cooling and low filtering effects are achieved. The smoking sensory quality of the smoke is significantly improved (see Table 1).

Embodiment 38

Figure 9:
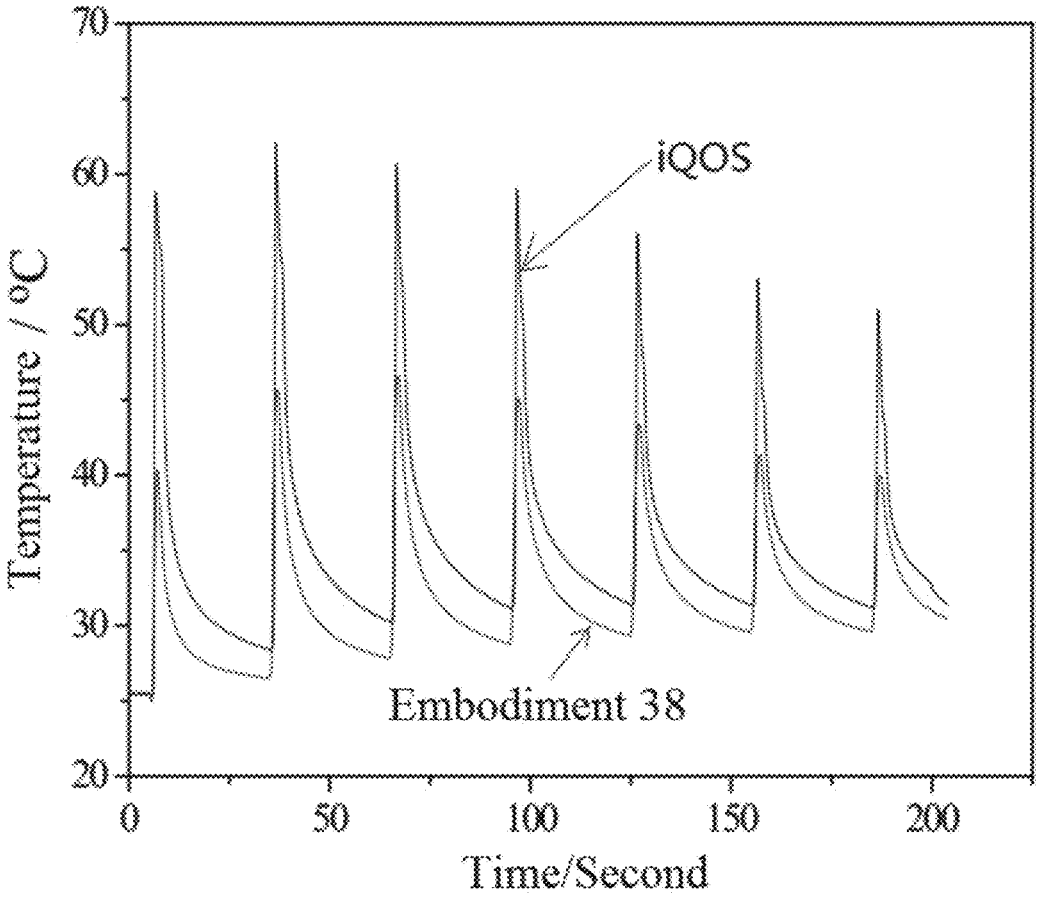
FIG. 9 is a temperature diagram of puffs of smoke in sequence in Embodiment 38 and iQOS.

Embodiment 1 is repeated, only the cooling material is changed to a mixture of low molecular weight PEG400, medium molecular weight PEG4000, high molecular weight PEG8000 and polydextrose, and the weight ratio of the four is 2:7:4:1. The coating amount of the cooling material is 55% of the total weight of the paper. Through comparative studies, it is found that the cooling section designed in the present invention is used to replace a creased PLA film cooling section in an iQOS cigarette, and the puff temperature of smoke is shown in FIG. 9. From FIG. 9, the maximum temperature of smoke entering the mouth is 46° C., which is 16° C. lower than the temperature of iQOS smoke entering the mouth; meanwhile, the total particulate matter in the smoke is 15.8 mg/cig, which is 0.6 mg/cig higher than that of the iQOS smoke; and the cooling and low filtering effects are achieved. The smoking sensory quality of the smoke is significantly improved (see Table 1).

Comparative Example 1

Embodiment 28 is repeated, and the only difference is that the coating amount of the cooling material is 12% of the total weight of the paper. Through comparative studies, it is found that when the cooling section designed in the present invention is used to replace a creased PLA film cooling section in an iQOS cigarette, the maximum temperature of smoke entering the mouth is 66° C., which is 4° C. higher than the temperature of iQOS smoke entering the mouth; meanwhile, the total particulate matter in the smoke is 5.5 mg/cig, which is 9.7 mg/cig lower than that of the iQOS smoke; the amount of smoke entering the mouth is obviously decreased, and the cooling effect cannot be achieved and more smoke will be entrapped (see Table 1).

Comparative Example 2

Embodiment 28 is repeated, and the only difference is that the coating amount of the cooling material is 8% of the total weight of the paper. Through comparative studies, it is found that when the cooling section designed in the present invention is used to replace a creased PLA film cooling section in an iQOS cigarette, the maximum temperature of smoke entering the mouth is 69° C., which is 7° C. higher than the temperature of iQOS smoke entering the mouth; meanwhile, the total particulate matter in the smoke is 4.3 mg/cig, which is 10.9 mg/cig lower than that of the iQOS smoke; the amount of smoke entering the mouth is obviously decreased, and the cooling effect cannot be achieved and more smoke will be entrapped (see Table 1).

Comparative Example 3

Embodiment 1 is repeated, and the only difference is that the coating amount of the cooling material is 0. Through comparative studies, it is found that when the cooling section designed in the present invention is used to replace a creased PLA film cooling section in an iQOS cigarette, the maximum temperature of smoke entering the mouth is 72° C., which is 10° C. higher than the temperature of iQOS smoke entering the mouth; meanwhile, the total particulate matter in the smoke is reduced to 2.6 mg/cig, which is 12.6 mg/cig lower than that of the iQOS smoke; the amount of smoke entering the mouth is obviously decreased, and the cooling effect cannot be achieved and more smoke will be entrapped (see Table 1).

Comparative Example 4

Embodiment 1 is repeated, and the only differences are that the cellulose paper is changed to coated paper, and the coating amount of the cooling material is 0. Through comparative studies, it is found that when the cooling section designed in the present invention is used to replace a creased PLA film cooling section in an iQOS cigarette, the maximum temperature of smoke entering the mouth is 73° C., which is 11° C. higher than the temperature of iQOS smoke entering the mouth; meanwhile, the total particulate matter in the smoke is reduced to 3.1 mg/cig, which is 12.1 mg/cig lower than that of the iQOS smoke; the amount of smoke entering the mouth is obviously decreased, and the cooling effect cannot be achieved and more smoke will be entrapped (see Table 1).

Comparative Example 5

Embodiment 1 is repeated, and the only differences are that the cellulose paper is changed to forming paper, and the coating amount of the cooling material is 0. Through comparative studies, it is found that when the cooling section designed in the present invention is used to replace a creased PLA film cooling section in an iQOS cigarette, the maximum temperature of smoke entering the mouth is 74° C., which is 12° C. higher than the temperature of iQOS smoke entering the mouth; meanwhile, the total particulate matter in the smoke is reduced to 3.5 mg/cig, which is 11.7 mg/cig lower than that of the iQOS smoke; the amount of smoke entering the mouth is obviously decreased, and the cooling effect cannot be achieved and more smoke will be entrapped (see Table 1).

TABLE 1

Maximum temperature of smoke entering the mouth, total particulate matter and amount of smoke of heat-not-burn cigarettes

| Sample | Maximum temperature of smoke entering the mouth (° C.) | Total particulate matter (mg/cig) | Amount of smoke |
|---|---|---|---|
| iQOS used as control | 62 | 15.2 | Large |
| Embodiment 1 | 67 | 5.2 | Small |
| Embodiment 2 | 66 | 5.0 | Small |
| Embodiment 3 | 68 | 4.8 | Small |
| Embodiment 4 | 65 | 4.7 | Small |
| Embodiment 5 | 68 | 4.6 | Small |
| Embodiment 6 | 66 | 4.2 | Small |
| Embodiment 7 | 65 | 4.5 | Small |
| Embodiment 8 | 66 | 4.7 | Small |
| Embodiment 9 | 65 | 5.0 | Small |
| Embodiment 10 | 67 | 5.2 | Small |
| Embodiment 11 | 65 | 4.6 | Small |
| Embodiment 12 | 68 | 4.5 | Small |
| Embodiment 13 | 66 | 4.3 | Small |
| Embodiment 14 | 68 | 4.6 | Small |
| Embodiment 15 | 65 | 4.9 | Small |
| Embodiment 16 | 66 | 5.1 | Small |
| Embodiment 17 | 65 | 5.4 | Small |
| Embodiment 18 | 67 | 4.7 | Small |
| Embodiment 19 | 68 | 5.5 | Small |
| Embodiment 20 | 67 | 5.6 | Small |
| Embodiment 21 | 69 | 5.4 | Small |
| Embodiment 22 | 68 | 5.7 | Small |
| Embodiment 23 | 67 | 5.4 | Small |
| Embodiment 24 | 68 | 5.5 | Small |
| Embodiment 25 | 67 | 5.4 | Small |
| Embodiment 26 | 69 | 5.6 | Small |
| Embodiment 27 | 67 | 5.3 | Small |
| Embodiment 28 | 64 | 11.7 | Relatively large |
| Embodiment 29 | 53 | 14.9 | Large |
| Embodiment 30 | 51 | 15.5 | Large |
| Embodiment 31 | 52 | 15.7 | Large |
| Embodiment 32 | 49 | 15.2 | Large |
| Embodiment 33 | 48 | 15.5 | Large |
| Embodiment 34 | 51 | 15.0 | Large |
| Embodiment 35 | 52 | 15.1 | Large |
| Embodiment 36 | 47 | 15.4 | Large |
| Embodiment 37 | 48 | 15.6 | Large |
| Embodiment 38 | 46 | 15.8 | Large |
| Comparative Example 1 | 66 | 5.5 | Small |
| Comparative Example 2 | 69 | 4.3 | Small |
| Comparative Example 3 | 72 | 2.6 | Small |
| Comparative Example 4 | 73 | 3.1 | Small |
| Comparative Example 5 | 74 | 3.5 | Small |

The contents illustrated by the above embodiments should be understood as these embodiments are merely used for illustrating the present invention more clearly, rather than limiting the scope of the present invention. Various equivalent modifications made to the present invention by those skilled in the art after reading the present invention all fall within the scope defined by the appended claims of the present application.

The invention claimed is:

1. A cooling cigarette filter for reducing a temperature of smoke from a cigarette before entering a mouth, the cooling cigarette filter comprising a cooling section (2), wherein:

the cooling section (2) comprises a cooling stick (201) formed from paper (5), the cooling stick (201) has one or more holes (202) communicating two ends of the cooling stick, and cools smoke from the cigarette entering one end of the cooling stick such that smoke exiting the cooling stick at another end has a maximum temperature of 46-61° C. when entering the mouth, and the one or more holes (202) are formed by paper repeatedly bended or folded in a cylindrical space;

a surface of the paper (5) is coated with a cooling material, and a coating amount of the cooling material is at least 15% of a total weight of the paper; and the cooling material comprises at least two of low molecular weight polyethylene glycol (PEG), medium molecular weight PEG and high molecular weight PEG.

2. The cooling cigarette filter according to claim 1, wherein one or both surfaces of the paper (5) have multiple concave-convex lines.

3. The cooling cigarette filter according to claim 2, wherein a depth of the multiple concave-convex lines is 0.1 to 3 mm, and an interval between adjacent lines is 0.5 to 15 mm.

4. The cooling cigarette filter according to claim 1, wherein a cross section of the one or more holes (202) is irregular.

5. The cooling cigarette filter according to claim 1, wherein the paper (5) is one of cellulose paper, coated paper and wrap paper.

6. The cooling cigarette filter according to claim 1, wherein a total specific surface area of the one or more holes is 10% to 50% of a surface area of the paper (5).

7. The cooling cigarette filter according to claim 1, wherein a coating area of the cooling material on the surface of the paper (5) is 50% to 100% of a surface area of the paper.

8. The cooling cigarette filter according to claim 1, wherein one or both sides of the paper (5) are coated with the cooling material.

9. The cooling cigarette filter according to claim 1, wherein:

the surface of the paper (5) has a coating region coated with the cooling material and a blank region not coated with the cooling material, and the blank region and the coating region are distributed along a length of the cooling stick (201).

10. The cooling cigarette filter according to claim 1, wherein the paper (5) is rectangular when unfolded.

11. The cooling cigarette filter according to claim 1, wherein:

the cooling material is coated in at least two coating regions on a surface of the paper, and the at least two coating regions are distributed along a length of the cooling stick.

12. The cooling cigarette filter according to claim 1, wherein the cooling material further comprises one or more of polydextrose and lactitol.

13. The cooling cigarette filter according to claim 1, wherein in parts by mass, the cooling material comprises 0-10 parts of low molecular weight PEG, 0-10 parts of medium molecular weight PEG, and 0-10 parts of high molecular weight PEG, wherein a content of at most one of the low molecular weight PEG, the medium molecular weight PEG, and the high molecular weight PEG is 0.

14. The cooling cigarette filter according to claim 1, wherein the cooling stick is wrapped with wrap paper (4).

15. The cooling cigarette filter according to claim 1, wherein:

a filter section (1) is connected to one end of the cooling section (2), or two filter sections (1) are respectively connected to two ends of the cooling section (2).

16. The cooling cigarette filter according to claim 15, wherein the filter section has a length of 5 to 9 mm, and the cooling section has a length of 10 to 50 mm.

17. A cigarette, comprising a smoke generation section (3) and a cooling cigarette filter for reducing a temperature of smoke from a cigarette before entering a mouth, wherein the cooling cigarette filter comprises a cooling section (2), wherein:

the cooling section (2) comprises a cooling stick (201) formed from paper (5), the cooling stick (201) has one or more holes (202) communicating two ends of the cooling stick, and cools smoke from the cigarette entering one end of the cooling stick such that smoke exiting the cooling stick at another end has a maximum temperature of 46-61° C. when entering the mouth, and the one or more holes (202) are formed by paper repeatedly bended or folded in a cylindrical space;

a surface of the paper (5) is coated with a cooling material, and a coating amount of the cooling material is at least 15% of a total weight of the paper; and the cooling material comprises at least two of low molecular weight polyethylene glycol (PEG), medium molecular weight PEG and high molecular weight PEG.

18. The cigarette according to claim 17, wherein the smoke generation section has a length of 10 to 70 mm.

19. The cooling cigarette filter according to claim 1, wherein a basis weight of the paper is 40 to 100 g/m2.

20. The cooling cigarette filter according to claim 11, wherein a first of the at least two coating regions is coated with a first mixture of the cooling material, and a second of the at least two coating regions is coated with a second mixture of the cooling material that is different from the first mixture.

* * * * *